US008431194B2

(12) United States Patent
Noguchi et al.

(10) Patent No.: US 8,431,194 B2
(45) Date of Patent: Apr. 30, 2013

(54) RECORDING MEDIUM

(75) Inventors: Tetsuro Noguchi, Hachioji (JP); Hisao Kamo, Ushiku (JP); Yasuhiro Nito, Yokohama (JP); Ryo Taguri, Kawasaki (JP); Isamu Oguri, Yokohama (JP); Olivia Herlambang, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 178 days.

(21) Appl. No.: 12/891,700

(22) Filed: Sep. 27, 2010

(65) Prior Publication Data

US 2011/0076518 A1 Mar. 31, 2011

(30) Foreign Application Priority Data

Sep. 30, 2009 (JP) ..... 2009-226926

(51) Int. Cl.
*B41M 5/00* (2006.01)

(52) U.S. Cl.
USPC ..... 428/32.24; 428/32.25; 428/32.3; 428/32.34

(58) Field of Classification Search ..... 428/32.24, 428/32.25, 32.3, 32.34
See application file for complete search history.

(56) References Cited

U.S. PATENT DOCUMENTS

| | | | | |
|---|---|---|---|---|
| 4,202,870 | A | 5/1980 | Weber et al. | |
| 4,242,271 | A | 12/1980 | Weber et al. | |
| 2009/0011155 | A1 * | 1/2009 | Kamo et al. | 428/32.25 |

FOREIGN PATENT DOCUMENTS

| | | | |
|---|---|---|---|
| JP | S61-010483 | A | 1/1986 |
| JP | H05-016015 | A | 3/1993 |
| JP | H07-232473 | A | 9/1995 |
| JP | H07-232475 | A | 9/1995 |
| JP | H08-132731 | A | 5/1996 |
| JP | H09-066664 | A | 3/1997 |
| JP | H09-076628 | A | 3/1997 |
| JP | 2001-334742 | A | 12/2001 |
| JP | 2005-153315 | A | 6/2005 |
| WO | WO 2008/130045 | A1 * | 10/2008 |

* cited by examiner

*Primary Examiner* — Betelhem Shewareged
(74) *Attorney, Agent, or Firm* — Canon U.S.A., Inc., IP Division

(57) ABSTRACT

The invention provides a recording medium having 2 or more ink receiving layers on a substrate, wherein an upper layer of the ink receiving layers, which is a layer most distant from the substrate, and a lower layer, which is a layer located just under the upper layer, contain at least one selected from alumina hydrate and alumina, an acid and a hydrophilic binder, the acid contained in the upper layer is a carboxylic acid represented by the general formula [I], and the acid contained in the lower layer is a sulfonic acid represented by the general formula [II]

$R^1$—COOH General formula [I]

$R^2$—$SO_3H$. General formula [II]

3 Claims, No Drawings

RECORDING MEDIUM

BACKGROUND OF THE INVENTION

1. Field of the Invention

The present invention relates to a recording medium, and particularly to an ink jet recording medium.

2. Description of the Related Art

A photographic recording medium, particularly, an ink jet recording medium, achieving image quality comparable with that of a silver salt photograph using aqueous dye ink(s) is required to have good properties such as excellent color developability for dyes, high surface glossiness and image formability having high resolution. As a constituent material suitable for use in an ink receiving layer of a recording medium capable of providing image quality having such properties, is mentioned alumina hydrate or alumina, and such a material is described in Japanese Patent Application Laid-Open No. H07-232475.

On the other hand, in addition to the image quality of a recorded image, image fastness properties have come to be required in recent years. It is widely known that an image causes blurring due to diffusion of a dye in an ink receiving layer under a high-humidity environment in particular to greatly deteriorate the image quality. A magenta color tends to strongly show this deterioration phenomenon, and thus this phenomenon has not been permissible in an image forming method of forming a color image using a magenta ink. In order to overcome this phenomenon, Japanese Patent Application Laid-Open No. 2001-334742 has proposed causing a cationic polymer or a polyvalent metal salt to be contained in an ink receiving layer for aggregating and fixing a dye within the ink receiving layer.

As a recording medium capable of preventing bronzing under a high-humidity environment and improving image blurring, there is a recording medium described in Japanese Patent Application Laid-Open No. 2005-153315.

SUMMARY OF THE INVENTION

The present invention provides a recording medium comprising a substrate and two or more ink receiving layers provided on the substrate, wherein an upper layer of the ink receiving layers, which is a layer most distant from the substrate, and a lower layer, which is a layer located just under the upper layer, are ink receiving layers containing at least one selected from alumina hydrate and alumina, an acid and a hydrophilic binder, and wherein the acid contained in the upper layer is a carboxylic acid represented by the following general formula [I], and the acid contained in the lower layer is a sulfonic acid represented by the following general formula [II]:

$R^1$—COOH General formula [I]

[in the general formula [I], $R^1$ is a hydrogen atom or a branched or unbranched alkyl or alkenyl group having 1 to 3 carbon atoms, with the proviso that $R^1$ may have at least one of a hydroxyl group, an oxo group, an amino group (—NHR or —NRR'), an alkoxy group (—OR), an acyl group (R—CO—), alkanoylamino group (—NHCOR) and a carbamoyl group as a substituent, R and R' are, independently of each other, a hydrogen atom or an alkyl group having 1 or 2 carbon atoms, and R is not a hydrogen atom when the substituent is an alkoxy group or an alkanoylamino group]

$R^2$—$SO_3H$ General formula [II]

[in the general formula [II], $R^2$ is a hydrogen atom or a branched or unbranched alkyl or alkenyl group having 1 to 3 carbon atoms, with the proviso that $R^2$ may have at least one of an oxo group, halogen atoms, an alkoxy group (—OR) and an acyl group (R—CO—) as a substituent, R is a hydrogen atom or an alkyl group having 1 or 2 carbon atoms, and R is not a hydrogen atom when the substituent is an alkoxy group].

DESCRIPTION OF THE EMBODIMENTS

Preferred embodiments of the present invention will now be described in detail.

A recording medium which achieves image quality comparable with that of a silver salt photograph and excellent in both image blurring resistance under a high-temperature and high-humidity environment and bronzing resistance and has an ink receiving layer containing alumina hydrate or alumina is not yet provided.

According to the proposal of Japanese Patent Application Laid-Open No. 2001-334742, a dye is caused to aggregate by allowing a cationic polymer, a polyvalent metal salt or sulfonic acid that is a strong acid to be contained in an ink receiving layer for preventing image blurring under a high-humidity environment to make an image hard to blur. However, since the action of aggregating the dye to make the image hard to blur is utilized, the so-called bronzing, which is such a phenomenon that an imaged portion looks like metallic luster, may occur in some cases. The bronzing is considered to be caused by the condition that a dye in an ink excessively aggregates on the surface of a recording medium. In particular, a cyan ink using a metal phthalocyanine dye as a coloring material is liable to cause such a bronzing phenomenon that the tint of reflected light thereof is changed from the original white color to a red color when the shot-in ink quantity is great. The bronzing phenomenon causes non-uniformity in glossy appearance to greatly deteriorate the quality of a recorded article. It is thus an important technical subject to inhibit image blurring while preventing bronzing. Japanese Patent Application Laid-Open No. 2005-153315 only describes an example where silica was used. When the present inventors similarly carried out the example thereof by using alumina hydrate or alumina, the bronzing could not be sufficiently prevented in some cases.

The present inventors have carried out an extensive investigation as to the above-described subject. As a result, in a recording medium having an ink receiving layer formed of upper and lower layers containing at least one selected from alumina hydrate and alumina, an acid and a hydrophilic binder on a substrate, the following has been found. A deflocculant of a deflocculating liquid (sol) containing at least one of alumina hydrate and alumina contained in a coating liquid for ink receiving layers greatly affects the occurrence of image blurring and bronzing under a high-humidity environment.

More specifically, it has been found that when a sulfonic acid, in particular, a sulfonic acid having no hydrophilic substituent such as a hydroxyl group or amino group is used as a deflocculant for alumina hydrate or alumina, its inhibitory effect on the image blurring under the high-humidity environment is high.

To the contrary, it has also been found that when the sulfonic acid is used as the deflocculant, the bronzing phenomenon particularly easily occurs unlike the image blurring, while the bronzing phenomenon is hard to occur when a carboxylic acid is used as the flocculant, and its inhibitory effect is high. The reason for this is as follows. When the sulfonic acid is used as the deflocculant, a dye in an ink easily causes aggregation by aciding out in an ink receiving layer and hardly diffuses even under the high-humidity environment. It is thus considered that the bronzing phenomenon is easily caused, but the inhibitory effect on the image blurring is high. In particular, it is considered that when the sulfonic acid having no hydrophilic substituent such as a hydroxyl group or amino group is used, the alumina hydrate and alumina are hard to be hydrated even under the high-humidity environment, and so the inhibitory effect on the image blurring is higher. However, it is considered that a dye originally liable to aggregate, for example, a metal phthalocyanine type cyan dye, is aggregated in excess by the action of the sulfonic acid, whereby the bronzing phenomenon is easier to be caused.

On the other hand, when the carboxylic acid is used as the deflocculant, the bronzing phenomenon is hard to occur because its effect to aggregate a dye is poor. On the other hand, it is considered that the image blurring is easy to occur because the dye is easily re-dissolved and diffused in hydrated water contained in the ink receiving layer under the high-humidity environment.

The present inventors have further found that the cyan dye liable to cause the bronzing tends to be applied to a position distant from the substrate, i.e. a shallow position relatively near to the surface within the ink receiving layer. On the other hand, it has been found that a magenta dye liable to cause the image blurring under the high-humidity environment tends to permeate up to a position near to the substrate, i.e. a deep position relatively distant from the surface.

It is an object of the present invention to provide a recording medium that can effectively prevent image blurring under a high-humidity environment and a bronzing phenomenon.

The recording medium according to the present invention will hereinafter be described in detail.

Recording Medium

The recording medium according to the present invention has a substrate and at least two ink receiving layers provided on the substrate. The ink receiving layers are formed by, for example, applying a coating liquid on the substrate and drying the coating liquid. The recording medium according to the present invention has such a multi-layer structure that two or more ink receiving layers are provided on the substrate. An upper layer of the ink receiving layers, which is a layer most distant from the substrate, and a lower layer, which is a layer located just under the upper layer, contain at least one selected from alumina hydrate and alumina, an acid and a hydrophilic binder. The acid contained in the upper layer is a carboxylic acid represented by the general formula [I], and the acid contained in the lower layer is a sulfonic acid represented by the general formula [II]. For example, the upper layer can be formed by applying and drying a coating liquid for the upper layer containing a dispersion containing at least one selected from alumina hydrate and alumina deflocculated by the carboxylic acid represented by the general formula [I]. The lower layer arranged just under the upper layer of the ink receiving layers can be formed by applying and drying a coating liquid for the lower layer containing a dispersion containing at least one selected from alumina hydrate and alumina deflocculated by the sulfonic acid represented by the general formula [II]. In the present invention, the lower layer means an ink receiving layer arranged just under the upper layer which is a layer most distant from the substrate, i.e., an ink receiving layer adjoining the upper layer on the side of the substrate. When the ink receiving layer is composed of 3 or more layers, the ink receiving layer most distant from the substrate is referred to as an upper layer, and the ink receiving layer located just under the upper layer is referred to as a lower layer. Incidentally, when the ink receiving layer is composed of 3 or more layers, any other ink receiving layer than the upper and lower layers may be an ink receiving layer having the same composition as the upper or lower layer, or may be an ink receiving layer which is not defined in the present invention and has a publicly known composition. The recording medium according to the present invention may include a double-side recording medium with a multi-layer ink receiving layer including the upper and lower layers applied on both surfaces of a substrate. In addition, the recording medium according to the present invention is favorably used as an ink jet recording medium.

Substrate

Specific examples of the substrate used in the present invention include water-absorbable substrates such as plain paper and coat paper, and water-resistant substrates such as synthetic paper, plastic films and resin coated paper. In particular, resin coated paper is favorably used.

No particular limitation is imposed on the base paper of the resin coated paper, and paper generally used may be used. However, such smooth base paper as used in, for example, a substrate for photograph is favorable. As the pulp forming the base paper, is used one of natural pulp, regenerated pulp and synthetic pulp, or a mixture of two or more thereof. Additives generally used in paper making, such as a sizing agent, a paper-strengthening agent, a filler, an antioxidant, a fluorescent whitening agent and a dye, are incorporated into this base paper. In addition, the surface of the base paper may be coated with a surface sizing agent, a surface-strengthening agent, a fluorescent whitening agent, an antioxidant, a dye and/or an anchoring agent.

The thickness of the base paper for the resin coated paper used in the present invention is favorably 50 μm or more. When the thickness is 50 μm or more, it can be well prevented that the tensile strength and tear strength of the resulting recording medium are weakened and that the texture thereof is lowered. Incidentally, the upper limit of the thickness of the base paper is not particularly limited. However, the upper limit is favorably 350 μm or less. The upper limit of 350 μm or less can well prevent the handling of the resulting recording medium from becoming inconvenient and the cost from increasing. In addition, the base paper is favorably subjected to a surface treatment such as compression treatment by applying a pressure during paper making or after paper making to impart good surface smoothness thereof. However, the density of the base paper is favorably 0.6 g/cm$^3$ or more and 1.2 g/cm$^3$ or less. The density of 1.2 g/cm$^3$ or less can well prevent the cushioning property from lowering, the body from weakening and the resulting recording medium from causing a problem on conveyability. When the density is 0.6 g/cm$^3$ or more, it can be well prevented that the surface smoothness of the resulting recording medium is lowered. The density of the base paper is more favorably 0.7 g/cm$^3$ or more.

The thickness of the resin coating layer of the resin coated paper used in the present invention is generally favorably 5 μm or more and 50 μm or less, more favorably 8 μm or more and 40 μm or less. Basically, the thickness of the resin coating layer is suitably determined from curling property relating to the thickness of the base paper. However, when the thickness is 5 μm or more, it can be well prevented that water or gas permeability through the resin surface is increased and that the ink receiving layer is cracked due to folding. When the thickness is 50 μm or less, it can be well prevented that the curling resistance is lowered and that the resulting recording medium becomes hard to handle.

A resin for coating the front and back sides of the base paper is mainly at least one of low density polyethylene (LDPE) and high density polyethylene (HDPE). However, other linear low density polyethylene (LLDPE) and polypropylene may be partly used.

The resin coating layer on the side (front side) on which the ink receiving layer is formed is favorably a resin coating layer formed by adding rutile- or anatase-type titanium oxide, a fluorescent whitening agent and ultramarine blue into polyethylene to improve opacity, whiteness degree and hue, as widely conducted for photographic paper. The content of titanium oxide in the resin coating layer on the side (front side) on which the ink receiving layer is formed is favorably about 3% by mass or more and 20% by mass or less, more favorably 4% by mass or more and 13% by mass or less, based on the resin in the resin coating layer.

The resin coated paper may be used as glossy paper or such silk-finish-paper as provided in ordinary photographic paper by conducting the so-called embossing treatment at the time polyethylene is melt-extruded and applied on the surface of the base paper.

As the plastic film used in the present invention, is used a film produced from, for example, a thermoplastic resin such as polyethylene, polypropylene, polystyrene, polyvinyl chloride or polyester, or a thermosetting resin such as a urea resin, melamine resin or phenol resin. The thickness of a general plastic film used in the present invention is favorably 50 μm or more and 250 μm or less.

Ink Receiving Layer

The ink receiving layer used in the present invention is a multi-layer ink receiving layer having two or more layers, and the upper and lower layers thereof contains at least one selected from alumina hydrate and alumina, an acid and a hydrophilic binder. The ink receiving layer is formed by applying a coating liquid on a substrate and drying the coating liquid. As described above, an ink receiving layer having a publicly known composition may be used as other ink receiving layers than the upper and lower layers of the ink receiving layer, so that the upper layer and lower layer of the ink receiving layer will be described in detail in the present specification.

Coating Liquid

The coating liquids for the upper layer and lower layer used in the present invention contain a dispersion which is prepared by deflocculating at least one of alumina hydrate and alumina by a deflocculating acid, which will be described subsequently, and contains at least one of alumina hydrate and alumina, and a hydrophilic binder. The coating liquids for the upper layer and lower layer may contain a crosslinking agent, which will be described subsequently, and additives.

Alumina Hydrate and Alumina

At least one selected from alumina hydrate and alumina is favorably used in the upper and lower ink receiving layers used in the present invention. In particular, alumina hydrate is favorably used from the viewpoints of color developability and ink absorbency.

Alumina Hydrate

The alumina hydrate favorably used in the present invention is represented by the following general formula (1):

$$Al_2O_{3-n}(OH)_{2n}.mH_2O \quad (1)$$

wherein n is any one of 1, 2 and 3, and m is a number of 0 or more and 10 or less, favorably 0 or more and 5 or less. In many cases, $mH_2O$ represents an aqueous phase, which does not participate in the formation of a crystal lattice, but is able to eliminate. Therefore, m may take a value other than an integer. However, n and m are not 0 at the same time.

Among these, favorable alumina hydrate is alumina hydrate exhibiting a beohmite structure or amorphous structure when analyzed by the X-ray diffractometry. As specific examples thereof, may be mentioned the alumina hydrates described in Japanese Patent Application Laid-Open Nos. H07-232473, H08-132731, H09-066664 and H09-076628. Specific examples of the shape of the alumina hydrate used in the present invention include amorphous, spherical and platelet forms. Alumina hydrate having any one of these forms may be used, and those having different forms may be used in combination. In particular, alumina hydrate with a number average particle size of primary particles of 5 nm or more and 50 nm or less is favorable, and plate-like alumina hydrate having an aspect ratio of 2 or more is favorable.

The aspect ratio can be determined according to the method described in Japanese Patent Publication No. H05-016015. More specifically, the aspect ratio is expressed by a ratio of "diameter" to "thickness" of a particle. The term "diameter" as used herein means a diameter (equivalent circle diameter) of a circle having an area equal to a projected area of the particle, which has been obtained by observing the alumina hydrate through a microscope or electron microscope. Alumina hydrate having a specific surface area of 100 $m^2/g$ or more and 200 $m^2/g$ or less as calculated by the BET method is favorably used, and alumina hydrate having a BET specific surface area of 125 $m^2/g$ or more and 175 $m^2/g$ or less is more favorably used.

The BET method is a method for measuring the surface area of powder by a gas-phase adsorption method, and is a method for determining the total surface area that 1 g of a sample has, i.e., the specific surface area, from an adsorption isotherm. In the BET method, nitrogen gas is generally used as an adsorption gas, and a method of measuring an adsorption amount from a change in the pressure or volume of the gas to be adsorbed is oftenest used. At this time, the Brunauer-Emmett-Teller equation is most marked as that indicating the isotherm of multimolecular adsorption, called the BET equation and widely used in determination of the specific surface area. According to the BET method, the specific surface area is determined by finding an adsorption amount based on the BET equation and multiplying this value by an area occupied by a molecule adsorbed at the surface. In the BET method, the relationship between a certain relative pressure and an absorption amount is determined several times, and the slope and intercept of plots thereof are found by the method of least squares to derive the specific surface area. In the present invention, the relationship between the relative pressure and the absorption amount is determined several times to derive the specific surface area.

The alumina hydrate can be generally prepared according to a publicly known process such as a process of hydrolyzing an aluminum alkoxide or a process of hydrolyzing sodium aluminate as described in U.S. Pat. No. 4,242,271 or U.S. Pat. No. 4,202,870. The alumina hydrate can also be prepared by a publicly known process in which an aqueous solution of aluminum sulfate or aluminum chloride is added to an aqueous solution of sodium aluminate to conduct neutralization as described in Japanese Patent Publication No. S57-447605. Specific examples of the alumina hydrate suitable for use in the present invention include alumina hydrates showing a beohmite structure or amorphous structure when analyzed by the X-ray diffractometry and described in Japanese Patent Application Laid-Open Nos. H07-232473, H08-132731, H09-066664 and H09-076628. In addition, commercially available alumina hydrate (trade name: DISPERAL HP14, product of Sasol Co.) may be mentioned as a specific example of the alumina hydrate.

Alumina

As examples of the alumina, may be mentioned γ-alumina, α-alumina, δ-alumina, θ-alumina and χ-alumina. Among these, γ-alumina is favorable from the viewpoints of color developability and ink absorbency. The γ-alumina is obtained by heating and baking alumina hydrate prepared according to a publicly known process at a temperature of 400° C. or more and 900° C. or less.

The alumina hydrate and alumina may be used in combination. More specifically, the alumina hydrate and alumina are mixed and dispersed in a state of powder to prepare a dispersion liquid. An alumina hydrate dispersion liquid and an alumina dispersion liquid may also be mixed for use.

Aqueous Dispersion Containing Deflocculating Acid and at Least One of Alumina Hydrate and Alumina The alumina hydrate or alumina used in the present invention are contained in a state of an aqueous dispersion deflocculated by a deflocculant in coating liquids for upper and lower ink receiving layers. When the alumina hydrate and alumina are used singly, the aqueous dispersions thereof are referred to as an aqueous alumina hydrate dispersion and an aqueous alumina dispersion, respectively. The aqueous dispersion containing at least one of the alumina hydrate and alumina used in the present invention contains at least one of the alumina hydrate and alumina and an acid. An aqueous dispersion containing both alumina hydrate and alumina can be prepared by mixing the alumina hydrate and alumina in a state of powder and adding a dispersion medium and a deflocculant thereto. The aqueous dispersion containing both alumina hydrate and alumina can also be prepared by separately preparing an aqueous alumina hydrate dispersion and an aqueous alumina hydrate and then mixing such aqueous dispersions. The aqueous dispersion containing at least one of the alumina hydrate and alumina may contain a pigment dispersant, a thickener, a flowability modifier, an antifoaming agent, a foam inhibitor, a surfactant, a parting agent, a penetrant, a coloring pigment, a coloring dye, a fluorescent whitening agent, an ultraviolet absorbent, an antioxidant, a preservative, a mildew-proofing agent, a water-proofing agent, a dye fixer, a hardener and/or a weathering agent as needed. The dispersion medium of the aqueous dispersion containing at least one of the alumina hydrate and alumina is favorably water. In the present invention, an acid (deflocculating acid) is used as the flocculant. In the upper ink receiving layer most distant from the substrate, the deflocculating acid is a carboxylic acid represented by the following formula [I], and such a layer is formed by applying a coating liquid (coating liquid for upper layer) containing the aqueous dispersion containing at least one of the alumina hydrate and alumina deflocculated by such a carboxylic acid. In the lower ink receiving layer, the deflocculating acid is a sulfonic acid represented by the following formula [II], and such a layer is formed by applying a coating liquid (coating liquid for lower layer) containing the aqueous dispersion containing at least one of the alumina hydrate and alumina deflocculated by such a sulfonic acid.

Incidentally, it is supposed that when the above-described carboxylic acid and sulfonic acid are used in combination in the upper and lower layers, the image blurring resistance and the bronzing resistance are lowered.

$R^1$—COOH General formula [I]

[in the general formula [I], $R^1$ is a hydrogen atom or a branched or unbranched alkyl or alkenyl group having 1 to 3 carbon atoms, with the proviso that $R^1$ may have at least one of a hydroxyl group, an oxo group, an amino group (—NHR or —NRR'), an alkoxy group (—OR), an acyl group (R—CO—), alkanoylamino group (—NHCOR) and a carbamoyl group as a substituent, R and R' are, independently of each other, a hydrogen atom or an alkyl group having 1 or 2 carbon atoms, and R is not a hydrogen atom when the substituent is an alkoxy group or an alkanoylamino group]

$R^2$—$SO_3H$ General formula [II]

[in the general formula [II], $R^2$ is a hydrogen atom or a branched or unbranched alkyl or alkenyl group having 1 to 3 carbon atoms, with the proviso that $R^2$ may have at least one of an oxo group, halogen atoms, an alkoxy group (—OR) and an acyl group (R—CO—) as a substituent, R is a hydrogen atom or an alkyl group having 1 or 2 carbon atoms, and R is not a hydrogen atom when the substituent is an alkoxy group].

The deflocculating acid used in the present invention is supposed to be adsorbed and coordinated on the surface of the alumina hydrate or alumina in the aqueous dispersion (sol). The adsorbed state of the deflocculating acid is retained even after the coating liquid is applied and dried into a solid ink receiving layer. Therefore, it is supposed that the deflocculating acid used in the present invention is difficult to easily diffuse in the layer due to a convection action during the drying of the ink receiving layer so as to unify the concentration of the deflocculating acid in the whole multi-layer ink receiving layer. When the acid is applied by impregnation after the formation of the receiving layer, the acid uniformly permeates and diffuses in the each layer, so that it is difficult that the bronzing-preventing function in the upper layer and the image blurring-preventing function in the lower layer act mutually supplementally. As a result, the bronzing resistance and image blurring resistance tend to be lowered. It is thus favorable that the coating liquids contain the respective acids.

$R^1$ in the general formula [1] or $R^2$ in the general formula [II] is a hydrogen atom or a branched or unbranched alkyl or alkenyl group having 1 to 3 carbon atoms. In the case of a deflocculating acid in which $R^1$ or $R^2$ is an alkyl or alkenyl group having 4 or more carbon atoms or an aromatic ring, a coating liquid prepared by mixing a dispersion containing at least one of the alumina hydrate and alumina using this deflocculating acid and the hydrophilic binder is liable to cause gelling, so that such a deflocculating acid is unsuitable.

Specific examples of the carboxylic acid represented by the general formula [I] and contained in the upper ink receiving layer include formic acid, acetic acid, propionic acid, acrylic acid, butyric acid, isobutyric acid, crotonic acid, vinylacetic acid, methacrylic acid, methoxyacetic acid, ethoxyacetic acid, 3-hydroxypropionic acid, glycolic acid, lactic acid, pyruvic acid, glyoxylic acid, glyceric acid and 2-hydroxyisobutyric acid. These acids may be used either singly or in any combination thereof.

On the other hand, specific examples of the sulfonic acid represented by the general formula [II] and contained in the lower ink receiving layer include methanesulfonic acid, ethanesulfonic acid, 1-propane-sulfonic acid, 2-propane-sulfonic acid, chloromethane-sulfonic acid, dichloromethanesulfonic acid, trichloro-methanesulfonic acid and trifluoromethanesulfonic acid. These acids may be used either singly or in any combination thereof.

Solid Content Concentration of Dispersion Containing at Least One of Alumina Hydrate and Alumina The solid content concentrations of the dispersion containing at least one of the alumina hydrate and alumina in the coating liquids for the upper and lower layer are each favorably 10% by mass or more and 40% by mass or less. When the solid content concentration of the dispersion is 10% by mass or more, it can be well prevented that cracking occurs upon coating. When the solid content concentration of the dispersion is 40% by mass or less, it can be well prevented that the dispersion becomes unstable to easily gel and that the coating property of the coating liquid is deteriorated.

The solid content concentration of the dispersion is particularly favorably 20% by mass or more and 35% by mass or less from the viewpoint of viscosity stability of the dispersion. Incidentally, the solid content concentrations of the dispersion containing at least one of the alumina hydrate and alumina means the proportion, in terms of percent by mass, of the whole solid content of the dispersion containing at least one of the alumina hydrate and alumina in each of the coating liquids for upper and lower layer.

Amount of Acid Used

The amount of the acid used for deflocculating the alumina hydrate and alumina used in the present invention may vary according to the kind of the acid, and the particle sizes and specific surface areas of the alumina hydrate and alumina. However, the amount of the carboxylic acid represented by the general formula [I] and contained in the upper ink receiving layer is favorably 200 mmol or more and 500 mmol or less per 1 kg in total of the alumina hydrate and alumina. When the amount of the carboxylic acid used is 200 mmol or more, the coating liquid can be well prevented from greatly increasing its sol viscosity. When the amount of the carboxylic acid used is 500 mmol or less, the quality of the resulting image can be well prevented from being markedly lowered by occurrence of the bronzing phenomenon and/or blurring without more increasing the deflocculating effect.

The amount of the sulfonic acid represented by the general formula [II] and contained in the lower ink receiving layer is favorably 100 mmol or more and 300 mmol or less per 1 kg in total of the alumina hydrate and alumina.

When the amount of the sulfonic acid used is 100 mmol or more, the coating liquid can be well prevented from greatly increasing its sol viscosity, and the image blurring resistance under the high-humidity environment can be well prevented from being lowered. When the amount of the sulfonic acid used is 300 mmol or less, occurrence of the bronzing phenomenon and/or blurring can be well prevented without reaching the limit of the deflocculating effect, and the quality of the resulting image can be well prevented from being markedly lowered.

The particles of the alumina hydrate and alumina in the dispersion containing at least one of the alumina hydrate and alumina may be ground to a desired particle size by a physical unit using a grinding and deflocculating machine. As the grinding and deflocculating machine, may be used various kinds of deflocculating machines. Examples thereof include high-pressure homogenizers, ultrasonic homogenizers, wet media type grinding machines (sand mill and ball mill), continuous high-speed agitation type deflocculating machines and ultrasonic deflocculating machines.

Coating Liquid for Ink Receiving Layer

The coating liquids for upper and lower ink receiving layers used in the present invention can be prepared by adding a hydrophilic binder and a crosslinking agent to the dispersion containing at least one of the alumina hydrate and alumina. The upper and lower ink receiving layers can be formed by coating a substrate with these coating liquids and drying the coating liquids.

Hydrophilic Binder

The coating liquids for upper and lower ink receiving layers used in the present invention contain at least one of the alumina hydrate and alumina as an ink receiving material and besides a hydrophilic binder for retaining properties as a coating film. As the hydrophilic binder, may be used a publicly known binder. Examples thereof include polyvinyl alcohol and derivatives thereof, gelatin, polyvinyl pyrrolidone, polyethylene oxide, polyacrylic acid, polyacrylamide, dextrin, hydroxyethyl cellulose, carboxymethyl cellulose and starch. A hydrophilic binder relatively low in swelling property at about room temperature is favorably used from the viewpoint of the undesirable condition that voids can be well prevented from being closed by swelling of the hydrophilic binder upon initial permeation of an ink. A particularly favorable hydrophilic binder is completely or partially saponified polyvinyl alcohol or cationically modified polyvinyl alcohol. Polyvinyl alcohol having a saponification degree of from 80% by mol to 100% by mol (completely saponified) is particularly favorable from the viewpoints of water resistance, ink absorbency and color developability. Polyvinyl alcohol having a weight average polymerization degree of 500 or more and 5,000 or less is favorable from the viewpoint of preventing a coating surface from causing cracking upon drying. The saponification degree is a value measured according to the method of JIS K 6726 and is chemically the proportion of the number of moles of a hydroxyl group produced by a saponification reaction when polyvinyl acetate is saponified into polyvinyl alcohol.

Examples of the cationically modified polyvinyl alcohol include polyvinyl alcohol having any one of primary to tertiary amino groups and a quaternary ammonium group in a main or side chain of polyvinyl alcohol as described in, for example, Japanese Patent Application Laid-Open No. S61-010483.

The polyvinyl alcohol is favorably used in a state of an aqueous solution, and the dry solid content concentration of polyvinyl alcohol in the aqueous solution is favorably 3% by mass or more and 20% by mass or less. When the dry solid content concentration is 3% by mass or more and 20% by mass or less, the concentration of the coating liquid can be well prevented from being excessively lowered to greatly lowering a drying speed, and to the contrary, the viscosity of the coating liquid can be well prevented from being greatly increased due to excessive increase of the concentration of the coating liquid to impair the smoothness of the coating surface.

Amount Used

The amount of the hydrophilic binder is favorably 7% by mass or more and 15% by mass or less in terms of solid content based on the total amount of the alumina hydrate and alumina from the viewpoints of well preventing cracking of a coating surface upon drying and achieving excellent ink absorbency. Incidentally, this amount (% by mass) can be calculated according to a numerical expression of {(Solid content mass of hydrophilic binder)×100/(Total solid content mass of alumina hydrate and alumina)}.

In the upper and lower ink receiving layers and the coating liquids for ink receiving layers thereof, another water-insoluble binder than the hydrophilic binder, such as a polymer latex, may also be used in combination as needed. However, the water-insoluble binder in each layer and each coating liquid is favorably 50% by mass or less based on the hydrophilic binder. The total amount of the hydrophilic binder and the water-insoluble binder is favorably 5% by mass or more and 30% by mass or less based on the total amount of the alumina hydrate and alumina in each layer and each coating liquid.

Crosslinking Agent

The upper and lower ink receiving layers used in the present invention and the coating liquids for ink receiving layers thereof favorably contain a crosslinking agent together with the hydrophilic binder. The order of addition of them may be arbitrary. Specific examples of the crosslinking agent include aldehyde compounds, melamine compounds, isocyanate compounds, zirconium compounds, amide compounds, aluminum compounds, boric acid and boric acid salts. The crosslinking agent is favorably at least one of these compounds. Among these, boric acid and boric acid salts are favorable from the viewpoints of crosslinking rate and prevention of cracking of a coating surface. Examples of boric acid usable as the crosslinking agent include not only orthoboric acid ($H_3BO_3$) but also metaboric acid and hypoboric acid.

As examples of boric acid salts, may be mentioned orthoborates (for example, $InBO_3$, $ScBO_3$, $YBO_3$, $LaBO_3$, $Mg_3(BO_3)_2$ and $CO_3(BO_3)_2$), diborates (for example, $Mg_2B_2O_5$ and $CO_2B_2O_5$), metaborates (for example, $LiBO_2$, $Ca(BO_2)_2$, $NaBO_2$ and $KBO_2$), tetraborates (for example, $Na_2B_4O_7.10H_2O$), and pentaborates (for example, $KB_5O_8.4H_2O$, $Ca_2B_6O_{11}.7H_2O$ and $CsB_5O_5$). Among these boric acids and boric acid salts, orthoboric acid is favorably used from the viewpoints of stability with time of the coating liquids and an inhibitory effect on occurrence of cracking. The amount of the crosslinking agent added is favorably 0.2% by mass or more and 8.0% by mass or less, more favorably 0.5% by mass or more and 3.0% by mass or less, in terms of dry solid content based on the total dry solid content of the alumina hydrate and alumina making up each of the upper and lower ink receiving layers from the viewpoints of viscosity stability of the coating liquids and ink absorbency.

Orthoboric acid is favorably used in a state of an aqueous solution, and the dry solid content concentration of the aqueous solution is favorably 0.5% by mass or more and 8.0% by mass or less from the viewpoints of preventing great delay of a drying rate due to excessive lowering of the concentration of the coating liquid and preventing deposition of orthoboric acid.

Additives

The upper and lower ink receiving layers and the coating liquids for ink receiving layers thereof may contain various kinds of additives as needed. Examples of additives include fixing agents such as various kinds of cationic resins, flocculants such as polyvalent metal salts, surfactants, fluorescent whitening agents, thickeners, antifoaming agents, foam inhibitors, parting agents, penetrants, lubricants, ultraviolet absorbents, antioxidants, leveling agents, preservatives, pH adjustors, and various kinds of aids publicly known in the technical field of the present invention. The amounts of these additive added may be suitably adjusted.

Examples of usable cationic resins include polyethylene imine resins, polyamine resin, polyamide resins, polyamide epichlorohydrin resins, polyamine epichlorohydrin resins, polyamidopolyamine epichlorohydrin reins, polydiallylamine resins and dicyandiamide condensates. These water-soluble resins may be used either singly or in any combination thereof.

Formation of Ink Receiving Layer

Solid Content Coating Amount of Coating Liquid

The recording medium according to the present invention has two or more ink receiving layers. The solid content coating amount of the upper ink receiving layer is favorably 7 $g/m^2$ or more and 20 $g/m^2$ or less. When the solid content coating amount of the upper layer is 7 $g/m^2$ or more, it can be well prevented that the action of the sulfonic acid contained in the lower layer reaches the upper layer and that the bronzing resistance is lowered. When the solid content coating amount of the upper layer is 20 $g/m^2$ or less, it can be well prevented that the action of the sulfonic acid contained in the lower layer is weakened and that the image blurring resistance under the high-humidity environment is lowered. The solid content coating amount of the lower ink receiving layer is favorably 10 $g/m^2$ or more and 40 $g/m^2$ or less. When the solid content coating amount of the lower layer is 10 $g/m^2$ or more, it can be well prevented that the image blurring-preventing function under the high-humidity environment is substantially weakened and that the image blurring resistance is lowered. When the solid content coating amount of the lower layer is 40 $g/m^2$ or less, it can be well prevented that the coating surface is cracked upon drying due to the overthickness of the coating layer.

In the case of 3 or more ink receiving layers, the solid content coating amount of other ink receiving layers than the upper and lower ink receiving layers is favorably 0.05 $g/m^2$ or more and 30.00 $g/m^2$ or less.

Forming Method of Ink Receiving Layer

For a forming method of the ink receiving layer used in the present invention, may be used any publicly known coating system. Examples of such a system include a slot die system, a slide bead system, a curtain system, an extrusion system, an air knife system, a roll coating system and a rod bar coating system. The 2 or more ink receiving layers used in the present invention may be formed by conducting coating and drying by a sequential coating technique or a simultaneous multilayer coating technique. In particular, a simultaneous multilayer coating technique using the slide bead system is a favorable method in that productivity is high.

Upon drying after the coating, for example, a hot air dryer such as a linear tunnel dryer, arch dryer, air loop dryer or sine curve air float dryer, an infrared heating dryer, or a dryer utilizing microwave may be suitably chosen for use.

Examples

The present invention will hereinafter be described in detail by the following Examples and Comparative Examples. However, the contents of the present invention are not limited to these examples. Incidentally, "parts or part" means "parts or part by mass".

Preparation of Substrate

After 0.60 parts of cationized starch, 10 parts of heavy calcium carbonate, 15 parts of precipitated calcium carbonate, 0.10 parts of an alkyl ketene dimmer and 0.03 part of cationic polyacrylamide were externally added to a pulp composed of 80 parts of Laulholz bleached kraft pulp (LBKP) having a freeness of 450 ml CSF (Canadian Standard Freeness) and 20 parts of Nadelholz bleached kraft pulp (NBKP) having a freeness of 480 ml CSF, the resultant mixture was adjusted with water so as to give a solid content concentration of 3% by mass to obtain a paper stock. Paper was made from the resultant paper stock by means of a Fourdrinear paper machine, and the paper was subjected to a 3-stage wet pressing process and dried by a multi-cylinder dryer. After the paper was then impregnated with an aqueous solution of oxidized starch by a size presser so as to give a coating amount of 1.0 $g/m^2$ and dried, the thus-treated paper was finished by a machine calendar to obtain a base paper having a basis weight of 155 $g/m^2$.

A resin composition composed of low density polyethylene (70 parts), high density polyethylene (20 parts) and titanium oxide (10 parts) was applied in an amount of 25 $g/m^2$ on a front side of the paper base thus obtained to form a coating resin layer. A resin composition composed of high density polyethylene (50 parts) and low density polyethylene (50 parts) was applied in an amount of 30 $g/m^2$ on a back side of the paper base to form a coating resin layer, thereby obtaining resin coated paper. After the front side of the resin coated paper thus obtained was subjected to a corona discharge treatment, acid-treated gelatin was applied thereon so as to give a solid content coating amount of 0.05 g/m$^2$, thereby foaming an easily adherent layer, and the back side of the resin coated paper was subjected to a corona discharge treatment. Thereafter, a back layer containing about 0.4 g of a styrene-acrylic acid ester type latex binder having a Tg (glass transition point) of about 80° C., 0.1 g of an antioxidant (cationic polymer) and 0.1 g of colloidal silica was applied and formed on the back side of the resin coated paper to prepare a substrate.

Preparation of Recording Medium 1

Preparation of Alumina Hydrate Dispersion for Upper Ink Receiving Layer

To 333.00 parts of ion-exchanged water, was added 2.00 parts of acetic acid as a carboxylic acid represented by the general formula [I] to prepare an aqueous solution of acetic acid. While this aqueous solution of acetic acid was stirred under rotating conditions of 3,000 rpm by a homomixer (manufactured by Tokushu Kika Kogyo Co., Ltd., trade name: T.K. Homomixer MARK II Type 2.5), 100.00 parts of alumina hydrate (trade name: DISPERAL HP14, product of Sasol Co.) was gradually added. The stirring was continued for 30 minutes even after completion of the addition, thereby obtaining an aqueous dispersion of the alumina hydrate deflocculated by acetic acid. At this time, the content of acetic acid in the aqueous alumina hydrate dispersion was 333 mmol per 1 kg of the alumina hydrate, and the solid content concentration of the aqueous solution was 23% by mass.

Preparation of Alumina Hydrate Dispersion for Lower Ink Receiving Layer

To 333.00 parts of ion-exchanged water, was added 1.50 parts of methanesulfonic acid as a sulfonic acid represented by the general formula [II] to prepare an aqueous solution of methanesulfonic acid. While this aqueous solution of methanesulfonic acid was stirred under rotating conditions of 3,000 rpm by a homomixer (trade name: T.K. Homomixer MARK II Type 2.5, manufactured by Tokushu Kika Kogyo Co., Ltd.), 100.00 parts of alumina hydrate (trade name: DISPERAL HP14, product of Sasol Co.) was gradually added. The stirring was continued for 30 minutes even after completion of the addition, thereby obtaining an aqueous dispersion of the alumina hydrate deflocculated by methanesulfonic acid. At this time, the content of methanesulfonic acid in the aqueous alumina hydrate dispersion was 156 mmol per 1 kg of the alumina hydrate, and the solid content concentration of the aqueous solution was 23% by mass.

Coating Liquids for Upper Ink Receiving Layer and Lower Ink Receiving Layer

In each of the aqueous alumina hydrate dispersion for the upper ink receiving layer and the aqueous alumina hydrate dispersion for the lower ink receiving layer prepared above, was mixed a 3.0% by mass aqueous solution of orthoboric acid. At this time, the amount of the aqueous solution of orthoboric acid added to each of the aqueous dispersions was adjusted to 1.5 parts in terms of dry solid content per 100 parts in terms of dry solid content of the alumina hydrate in each aqueous dispersion. A 8.0% by mass (in terms of dry solid content) aqueous solution of polyvinyl alcohol (trade name: PVA 235, product of Kuraray Co., Ltd., weight average polymerization degree: 3,500, saponification degree: 88% by mol) as a hydrophilic binder was then mixed with each of the resultant mixtures. At this time, the amount of the aqueous polyvinyl alcohol solution added to each mixture was adjusted to 10 parts in terms of dry solid content per 100 parts in terms of dry solid content of the alumina hydrate in each mixture. Incidentally, when the dry solid content of the aqueous polyvinyl alcohol solution in each mixture after the addition of the aqueous PVA solution is regarded as 100 parts, the dry solid content of orthoboric acid added was 15 parts. The mixture for the lower ink receiving layer after the addition of the aqueous PVA solution was provided as a coating liquid for the lower ink receiving layer. A surfactant (trade name: Surfynol 465, product of Nisshin Chemical Industry Co., Ltd.) was further added to the mixture for the upper ink receiving layer after the addition of the aqueous PVA solution to prepare a coating liquid for the upper ink receiving layer. At that time, the surfactant was added in an amount of 0.1% by mass based on the whole mass of the coating liquid for the upper ink receiving layer.

Preparation of Ink Receiving Layer

The two kinds of coating liquids for upper and lower ink receiving layers were applied on the front side of the substrate by a multi-layer slide hopper type coater so as to form 2 layers in total of an upper layer and a lower layer. Incidentally, the solid content coating amounts of the lower and upper ink receiving layers were controlled to 30 g/m$^2$ and 10 g/m$^2$, respectively. The substrate was then dried at 60° C. to obtain Recording Medium 1.

Preparation of Recording Medium 2

Recording Medium 2 was obtained in the same manner as in Recording Medium 1 except that methanesulfonic acid used in the preparation of the aqueous alumina hydrate dispersion for the lower ink receiving layer in Recording Medium 1 was changed to the same parts of ethanesulfonic acid.

Preparation of Recording Medium 3

Recording Medium 3 was obtained in the same manner as in Recording Medium 1 except that methanesulfonic acid used in the preparation of the aqueous alumina hydrate dispersion for the lower ink receiving layer in Recording Medium 1 was changed to the same parts of propanesulfonic acid.

Preparation of Recording Medium 4

Recording Medium 4 was obtained in the same manner as in Recording Medium 1 except that methanesulfonic acid used in the preparation of the aqueous alumina hydrate dispersion for the lower ink receiving layer in Recording Medium 1 was changed to the same parts of trifluoromethanesulfonic acid.

Preparation of Recording Medium 5

Recording Medium 5 was obtained in the same manner as in Recording Medium 1 except that acetic acid used in the preparation of the aqueous alumina hydrate dispersion for the upper ink receiving layer in Recording Medium 1 was changed to the same parts of formic acid.

Preparation of Recording Medium 6

Recording Medium 6 was obtained in the same manner as in Recording Medium 1 except that acetic acid used in the preparation of the aqueous alumina hydrate dispersion for the upper ink receiving layer in Recording Medium 1 was changed to the same parts of propionic acid.

Preparation of Recording Medium 7

Recording Medium 7 was obtained in the same manner as in Recording Medium 1 except that acetic acid used in the preparation of the aqueous alumina hydrate dispersion for the upper ink receiving layer in Recording Medium 1 was changed to the same parts of butyric acid.

Preparation of Recording Medium 8

Recording Medium 8 was obtained in the same manner as in Recording Medium 1 except that acetic acid used in the preparation of the aqueous alumina hydrate dispersion for the upper ink receiving layer in Recording Medium 1 was changed to the same parts of lactic acid.

Preparation of Recording Medium 9

Recording Medium 9 was obtained in the same manner as in Recording Medium 1 except that acetic acid used in the preparation of the aqueous alumina hydrate dispersion for the upper ink receiving layer in Recording Medium 1 was changed to the same parts of pyruvic acid.

Preparation of Recording Medium 10

Recording Medium 10 was obtained in the same manner as in Recording Medium 1 except that acetic acid used in the preparation of the aqueous alumina hydrate dispersion for the upper ink receiving layer in Recording Medium 1 was changed to the same parts of vinylacetic acid.

Preparation of Recording Medium 11

Recording Medium 11 was obtained in the same manner as in Recording Medium 1 except that the 8.0% by mass (in terms of dry solid content) aqueous solution of polyvinyl alcohol used in the preparation of the aqueous alumina hydrate dispersion for the upper ink receiving layer in Recording Medium 1 was changed to the same parts of a 8.0% by mass (in terms of dry solid content) aqueous solution of polyvinyl pyrrolidone (hydrophilic binder, trade name: K-85, product of NIPPON SHOKUBAI CO., LTD.).

Preparation of Recording Medium 12

Recording Medium 12 was obtained in the same manner as in Recording Medium 1 except that the addition amount of acetic acid used in the preparation of the aqueous alumina hydrate dispersion for the upper ink receiving layer in Recording Medium 1 was changed from 2.00 parts to 1.10 parts. At this time, the content of acetic acid in the aqueous alumina hydrate dispersion in the coating liquid for the upper layer was 183 mmol per 1 kg of the alumina hydrate.

Preparation of Recording Medium 13

Recording Medium 13 was obtained in the same manner as in Recording Medium 1 except that the addition amount of acetic acid used in the preparation of the aqueous alumina hydrate dispersion for the upper ink receiving layer in Recording Medium 1 was changed from 2.00 parts to 1.20 parts. At this time, the content of acetic acid in the aqueous alumina hydrate dispersion in the coating liquid for the upper layer was 200 mmol per 1 kg of the alumina hydrate.

Preparation of Recording Medium 14

Recording Medium 14 was obtained in the same manner as in Recording Medium 1 except that the addition amount of acetic acid used in the preparation of the aqueous alumina hydrate dispersion for the upper ink receiving layer in Recording Medium 1 was changed from 2.00 parts to 3.00 parts. At this time, the content of acetic acid in the aqueous alumina hydrate dispersion in the coating liquid for the upper layer was 500 mmol per 1 kg of the alumina hydrate.

Preparation of Recording Medium 15

Recording Medium 15 was obtained in the same manner as in Recording Medium 1 except that the addition amount of acetic acid used in the preparation of the aqueous alumina hydrate dispersion for the upper ink receiving layer in Recording Medium 1 was changed from 2.00 parts to 3.30 parts. At this time, the content of acetic acid in the aqueous alumina hydrate dispersion in the coating liquid for the upper layer was 550 mmol per 1 kg of the alumina hydrate.

Preparation of Recording Medium 16

Recording Medium 16 was obtained in the same manner as in Recording Medium 1 except that the addition amount of methanesulfonic acid used in the preparation of the aqueous alumina hydrate dispersion for the lower ink receiving layer in Recording Medium 1 was changed from 1.50 parts to 0.90 parts. At this time, the content of methanesulfonic acid in the aqueous alumina hydrate dispersion in the coating liquid for the lower layer was 94 mmol per 1 kg of the alumina hydrate.

Preparation of Recording Medium 17

Recording Medium 17 was obtained in the same manner as in Recording Medium 1 except that the addition amount of methanesulfonic acid used in the preparation of the aqueous alumina hydrate dispersion for the lower ink receiving layer in Recording Medium 1 was changed from 1.50 parts to 2.88 parts. At this time, the content of methanesulfonic acid in the aqueous alumina hydrate dispersion in the coating liquid for the lower layer was 100 mmol per 1 kg of the alumina hydrate.

Preparation of Recording Medium 18

Recording Medium 18 was obtained in the same manner as in Recording Medium 1 except that the addition amount of methanesulfonic acid used in the preparation of the aqueous alumina hydrate dispersion for the lower ink receiving layer in Recording Medium 1 was changed from 1.50 parts to 3.00 parts. At this time, the content of methanesulfonic acid in the aqueous alumina hydrate dispersion in the coating liquid for the lower layer was 300 mmol per 1 kg of the alumina hydrate.

Preparation of Recording Medium 19

Recording Medium 19 was obtained in the same manner as in Recording Medium 1 except that the addition amount of methanesulfonic acid used in the preparation of the aqueous alumina hydrate dispersion for the lower ink receiving layer in Recording Medium 1 was changed from 1.50 parts to 3.00 parts. At this time, the content of methanesulfonic acid in the aqueous alumina hydrate dispersion in the coating liquid for the lower layer was 312 mmol per 1 kg of the alumina hydrate.

Preparation of Recording Medium 20

Recording Medium 20 was obtained in the same manner as in Recording Medium 1 except that the solid content coating amount of the upper layer upon the preparation of the ink receiving layers in Recording Medium 1 was changed to 5 g/m$^2$.

Preparation of Recording Medium 21

Recording Medium 21 was obtained in the same manner as in Recording Medium 1 except that the solid content coating amount of the upper layer upon the preparation of the ink receiving layers in Recording Medium 1 was changed to 7 g/m$^2$.

Preparation of Recording Medium 22

Recording Medium 22 was obtained in the same manner as in Recording Medium 1 except that the solid content coating amount of the lower layer upon the preparation of the ink receiving layers in Recording Medium 1 was changed to 40 g/m$^2$.

Preparation of Recording Medium 23

Recording Medium 23 was obtained in the same manner as in Recording Medium 1 except that the solid content coating amount of the lower layer upon the preparation of the ink receiving layers in Recording Medium 1 was changed to 43 g/m$^2$. At this time, some cracks upon drying occurred in a coating surface. However, no problem was caused upon practical use.

Preparation of Recording Medium 24

Recording Medium 24 was obtained in the same manner as in Recording Medium 1 except that the solid content coating amounts of the upper and lower layers upon the preparation of the ink receiving layers in Recording Medium 1 was changed to 25 g/m$^2$ and 15 g/m$^2$, respectively.

Preparation of Recording Medium 25

Recording Medium 25 was obtained in the same manner as in Recording Medium 1 except that the solid content coating amounts of the upper and lower layers upon the preparation of the ink receiving layers in Recording Medium 1 was changed to 30 g/m$^2$ and 10 g/m$^2$, respectively.

Preparation of Recording Medium 26

Recording Medium 26 was obtained in the same manner as in Recording Medium 1 except that the solid content coating amounts of the upper and lower layers upon the preparation of the ink receiving layers in Recording Medium 1 was changed to 33 g/m$^2$ and 7 g/m$^2$, respectively.

Preparation of Recording Medium 27

Recording Medium 27 was obtained in the same manner as in Recording Medium 1 except that the alumina hydrate used in the preparation of the aqueous alumina hydrate dispersions for upper and lower ink receiving layers in Recording Medium 1 was changed to the same parts of γ-alumina (product of Sumitomo Chemical Co., Ltd., trade name: AKP-G015).

Preparation of Recording Medium 28

Recording Medium 28 was obtained in the same manner as in Recording Medium 1 except that ink receiving layers of 3 layers in total having an ink receiving layer having the same composition as the upper layer in Recording Medium 1 and a solid content coating amount of 10 g/m$^2$ between the lower layer and the substrate in Recording Medium 1 were formed by a multi-layer slide hopper type coater.

Preparation of Recording Medium 29

Recording Medium 29 was obtained in the same manner as in Recording Medium 1 except that the aqueous alumina hydrate dispersion for the lower ink receiving layer in Recording Medium 1 was changed to the aqueous alumina hydrate dispersion for the upper ink receiving layer in Recording Medium 1.

Preparation of Recording Medium 30

Recording Medium 30 was obtained in the same manner as in Recording Medium 1 except that the aqueous alumina hydrate dispersion for the lower ink receiving layer in Recording Medium 1 was changed to the aqueous alumina hydrate dispersion for the upper ink receiving layer in Recording Medium 9.

Preparation of Recording Medium 31

Recording Medium 31 was obtained in the same manner as in Recording Medium 1 except that methanesulfonic acid used in the preparation of the aqueous alumina hydrate dispersion for the lower ink receiving layer in Recording Medium 1 was changed to amidosulfuric acid, and the addition amount thereof was changed from 1.50 parts to 1.51 parts. At this time, the content of amidosulfuric acid in the aqueous alumina hydrate dispersion in the coating liquid for the lower layer was 156 mmol per 1 kg of the alumina hydrate.

Preparation of Recording Medium 32

Recording Medium 32 was obtained in the same manner as in Recording Medium 1 except that methanesulfonic acid used in the preparation of the aqueous alumina hydrate dispersion for the lower ink receiving layer in Recording Medium 1 was changed to hydrochloric acid, and the addition amount thereof was changed from 1.50 parts to 0.57 parts. At this time, the content of hydrochloric acid in the aqueous alumina hydrate dispersion in the coating liquid for the lower layer was 156 mmol per 1 kg of the alumina hydrate.

Preparation of Recording Medium 33

Recording Medium 33 was obtained in the same manner as in Recording Medium 1 except that 1.50 parts of methanesulfonic acid used in the preparation of the aqueous alumina hydrate dispersion for the lower ink receiving layer in Recording Medium 1 was changed to a mixed acid of 1.00 part of methanesulfonic acid and 0.60 parts of acetic acid. At this time, the total content of methanesulfonic acid and acetic acid in the aqueous alumina hydrate dispersion in the coating liquid for the lower layer was 204 mmol per 1 kg of the alumina hydrate.

Preparation of Recording Medium 34

It was attempted to prepare Recording Medium 34 in the same manner as in Recording Medium 1 except that 1.50 parts of methanesulfonic acid used in the preparation of the aqueous alumina hydrate dispersion for the lower ink receiving layer in Recording Medium 1 was changed to 2.50 parts of benzenesulfinic acid. However, the preparation was impossible because the coating liquid for the lower ink receiving layer was gelled. At this time, the content of benzenesulfinic acid in the aqueous alumina hydrate dispersion in the coating liquid for the lower layer was 157 mmol per 1 kg of the alumina hydrate.

Preparation of Recording Medium 35

It was attempted to prepare Recording Medium 35 in the same manner as in Recording Medium 1 except that 2.00 parts of acetic acid used in the preparation of the aqueous alumina hydrate dispersion for the upper ink receiving layer in Recording Medium 1 was changed to 3.40 parts of pivalic acid. However, the preparation was impossible because the coating liquid for the lower ink receiving layer was gelled. At this time, the content of pivalic acid in the aqueous alumina hydrate dispersion in the coating liquid for upper layer was 333 mmol per 1 kg of the alumina hydrate.

Preparation of Recording Medium 36

Recording Medium 36 was obtained in the same manner as in Recording Medium 1 except that the aqueous alumina hydrate dispersion for the upper ink receiving layer in Recording Medium 1 was changed to the aqueous alumina hydrate dispersion for the lower ink receiving layer in Recording Medium 1.

Preparation of Recording Medium 37

Recording Medium 37 was obtained in the same manner as in Recording Medium 1 except that the aqueous alumina hydrate dispersion for the upper ink receiving layer in Recording Medium 1 was changed to the aqueous alumina hydrate dispersion for the lower ink receiving layer in Recording Medium 16.

Preparation of Recording Medium 38

Recording Medium 38 was obtained in the same manner as in Recording Medium 1 except that the aqueous alumina hydrate dispersion for the upper ink receiving layer in Recording Medium 1 was changed to the aqueous alumina hydrate dispersion for the lower ink receiving layer in Recording Medium 33.

Preparation of Recording Medium 39

Recording Medium 39 was obtained in the same manner as in Recording Medium 1 except that the aqueous alumina hydrate dispersion for the upper ink receiving layer and the aqueous alumina hydrate dispersion for the lower ink receiving layer in Recording Medium 1 were both changed to the aqueous alumina hydrate dispersion for the lower ink receiving layer in Recording Medium 33.

The compositions of these Recording Media 1 to 39 are shown in Table 1.

Evaluating Methods

Bronzing Resistance

After each of the above-described recording media was stored for 6 hours under a high-humidity environment of 30° C. temperature and 80% relative humidity, a cyan solid image was printed thereon by a commercially available ink jet printer (manufactured by Canon Inc., trade name: MP980) under the same environment. Whether bronzing occurred or not was visually evaluated based on the following evaluation criteria. Evaluated results are shown in Table 1.

Evaluation Criteria

AA: No occurrence of bronzing was observed;

A: A red tint was slightly observed in reflected light;

B: A red tint was observed in reflected light;

C: Metallic luster-like bronzing occurred.

Image Blurring Under High-Humidity Environment

Blue, green and red solid images were printed (Shot-in ink quantity: 200%) on the above-described recording media by a commercially available ink jet printer (manufactured by Canon Inc., trade name: MP980) to prepare printed samples. Thereafter, the printed samples were respectively stored for one week under a high-humidity environment of 30° C. temperature and 90% relative humidity, and image blurring on each color was then visually observed to make evaluation based on the following standard. Evaluated results are shown in Table 1.

Evaluation Criteria

AA: No blurring occurred in all of the colors;

A: Blurring slightly occurred in some of the colors;

B: Blurring somewhat occurred in some of the colors;

C: Blurring markedly occurred in some of the colors.

TABLE 1

| | | Deflocculating acid for alumina hydrate or alumina in upper layer | Amount of deflocculating acid in upper layer (mmol/kg of alumina (hydrate)) | Deflocculating acid for alumina hydrate or alumina in upper layer | Amount of deflocculating acid in upper layer (mmol/kg of alumina (hydrate)) | Coating amount of ink receiving layer ($g/m^2$) (upper layer/ lower layer) | Bronzing | Image blurring under high humidity |
|---|---|---|---|---|---|---|---|---|
| Ex. 1 | R. med. 1 | Acetic acid | 333 | Methane-sulfonic acid | 156 | 10/30 | AA | AA |
| Ex. 2 | R. med. 2 | Acetic acid | 333 | Ethane-sulfonic acid | 136 | 10/30 | AA | AA |
| Ex. 3 | R. med. 3 | Acetic acid | 333 | Propane-sulfonic acid | 121 | 10/30 | AA | AA |
| Ex. 4 | R. med. 4 | Acetic acid | 333 | Trifluoromethane-sulfonic acid | 100 | 10/30 | B | AA |
| Ex. 5 | R. med. 5 | Formic acid | 435 | Methane-sulfonic acid | 156 | 10/30 | A | AA |
| Ex. 6 | R. med. 6 | Propionic acid | 270 | Methane-sulfonic acid | 156 | 10/30 | AA | AA |
| Ex. 7 | R. med. 7 | Butyric acid | 227 | Methane-sulfonic acid | 156 | 10/30 | AA | AA |
| Ex. 8 | R. med. 8 | Lactic acid | 222 | Methane-sulfonic acid | 156 | 10/30 | AA | AA |

TABLE 1-continued

| | | Deflocculating acid for alumina hydrate or alumina in upper layer | Amount of deflocculating acid in upper layer (mmol/kg of alumina (hydrate)) | Deflocculating acid for alumina hydrate or alumina in upper layer | Amount of deflocculating acid in upper layer (mmol/kg of alumina (hydrate)) | Coating amount of ink receiving layer ($g/m^2$) (upper layer/ lower layer) | Bronzing | Image blurring under high humidity |
|---|---|---|---|---|---|---|---|---|
| Ex. 9 | R. med. 9 | Pyruvic acid | 227 | Methane-sulfonic acid | 156 | 10/30 | A | AA |
| Ex. 10 | R. med. 10 | Vinylacetic acid | 232 | Methane-sulfonic acid | 156 | 10/30 | A | AA |
| Ex. 11 | R. med. 11 | Acetic acid | 333 | Methane-sulfonic acid | 156 | 10/30 | AA | AA |
| Ex. 12 | R. med. 12 | Acetic acid | 183 | Methane-sulfonic acid | 156 | 10/30 | AA | B |
| Ex. 13 | R. med. 13 | Acetic acid | 200 | Methane-sulfonic acid | 156 | 10/30 | AA | A |
| Ex. 14 | R. med. 14 | Acetic acid | 500 | Methane-sulfonic acid | 156 | 10/30 | A | AA |
| Ex. 15 | R. med. 15 | Acetic acid | 550 | Methane-sulfonic acid | 156 | 10/30 | B | AA |
| Ex. 16 | R. med. 16 | Acetic acid | 333 | Methane-sulfonic acid | 94 | 10/30 | AA | B |
| Ex. 17 | R. med. 17 | Acetic acid | 333 | Methane-sulfonic acid | 100 | 10/30 | AA | A |
| Ex. 18 | R. med. 18 | Acetic acid | 333 | Methane-sulfonic acid | 300 | 10/30 | A | AA |
| Ex. 19 | R. med. 19 | Acetic acid | 333 | Methane-sulfonic acid | 312 | 10/30 | B | AA |
| Ex. 20 | R. med. 20 | Acetic acid | 333 | Methane-sulfonic acid | 156 | 5/30 | B | A |
| Ex. 21 | R. med. 21 | Acetic acid | 333 | Methane-sulfonic acid | 156 | 7/30 | A | AA |
| Ex. 22 | R. med. 22 | Acetic acid | 333 | Methane-sulfonic acid | 156 | 10/40 | AA | AA |
| Ex. 23 | R. med. 23 | Acetic acid | 333 | Methane-sulfonic acid | 156 | 10/43 | AA | AA |
| Ex. 24 | R. med. 24 | Acetic acid | 333 | Methane-sulfonic acid | 156 | 25/15 | AA | A |
| Ex. 25 | R. med. 25 | Acetic acid | 333 | Methane-sulfonic acid | 156 | 30/10 | AA | A |
| Ex. 26 | R. med. 26 | Acetic acid | 333 | Methane-sulfonic acid | 156 | 33/7 | AA | B |
| Ex. 27 | R. med. 27 | Acetic acid | 333 | Methane-sulfonic acid | 156 | 10/30 | AA | A |
| Ex. 28 | R. med. 28 | Acetic acid | 333 | Methane-sulfonic acid | 156 | 10/30 | AA | AA |
| Comp. Ex. 1 | R. med. 29 | Acetic acid | 333 | Acetic acid | 333 | 10/30 | AA | C |
| Comp. Ex. 2 | R. med. 30 | Acetic acid | 333 | Pyruvic acid | 227 | 10/30 | AA | C |
| Comp. Ex. 3 | R. med. 31 | Acetic acid | 333 | Amidosulfuric acid | 156 | 10/30 | AA | C |
| Comp. Ex. 4 | R. med. 32 | Acetic acid | 333 | Hydrochloric acid | 156 | 10/30 | B | C |
| Comp. Ex. 5 | R. med. 33 | Acetic acid | 333 | Acetic acid, methane-sulfonic acid | 204 | 10/30 | A | C |
| Comp. Ex. 6 | R. med. 34 | Acetic acid | 333 | Benzene-sulfonic acid | 157 | Impossible coating | | |
| Comp. Ex. 7 | R. med. 35 | Pivalic acid | 333 | Methane-sulfonic acid | 156 | Impossible coating | | |
| Comp. Ex. 8 | R. med. 36 | Methane-sulfonic acid | 156 | Methane-sulfonic acid | 156 | 10/30 | C | A |
| Comp. Ex. 9 | R. med. 37 | Methane-sulfonic acid | 94 | Methane-sulfonic acid | 156 | 10/30 | C | A |
| Comp. Ex. 10 | R. med. 38 | Acetic acid, methane-sulfonic acid | 204 | Methane-sulfonic acid | 156 | 10/30 | C | A |
| Comp. Ex. 11 | R. med. 39 | Acetic acid, methane-sulfonic acid | 204 | Acetic acid, methane-sulfonic acid | 204 | 10/30 | C | C |

(Note)

R. med.: Recording medium

As shown in Table 1, Examples 1 to 28 (Recording Media 1 to 28) are good in bronzing resistance and image blurring resistance under a high-humidity environment. In these examples, the acid contained in the upper ink receiving layer corresponds to an acid represented by the general formula [I], and the acid contained in the lower ink receiving layer corresponds to an acid represented by the general formula [II].

On the other hand, Comparative Examples (Recording Media 29 and 30) where the carboxylic acid represented by the general formula [I] was used in the lower ink receiving layer showed considerably lowered image blurring resistance under a high-humidity environment compared with Recording Medium 1. Comparative Example (Recording Medium 31) where a sulfonic acid in which $R^2$ in general formula [II] is an amino group with high hydrophilicity was used showed lowered image blurring resistance under a high-humidity environment compared with Recording Medium 1.

Comparative Example (Recording Medium 32) where hydrochloric acid that is an inorganic acid was used in the lower ink receiving layer showed lowered image blurring resistance compared with Recording Medium 1.

In Comparative Examples (Recording Media 34 and 35) where a carboxylic acid or sulfonic acid in which $R^1$ or $R^2$ in general formula [I] or [II] has 4 or more carbon atoms was used, the aqueous alumina hydrate dispersion using this acid underwent gelling upon the preparation of a coating liquid, and so coating was impossible.

Comparative Examples (Recording media 36 and 37) where the sulfonic acid represented by the general formula [II] was used in the upper ink receiving layer showed lowered bronzing resistance compared with Recording Medium 1.

Comparative Examples (Recording media 33, 38 and 39) where the acids represented by the general formulae [I] and [II] were used in combination showed at least one of lowered image blurring resistance and lowered bronzing resistance compared with Recording Medium 1. From this fact, it is understood that a highly advantageous effect is recognized when the carboxylic acid represented by the general formula [I] is used singly in the upper ink receiving layer, and the sulfonic acid represented by the general formula [II] is used singly in the lower ink receiving layer without using both acids in combination.

According to the present invention, there can be provided recording media capable of effectively preventing image blurring under a high-humidity environment and a bronzing phenomenon.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-226926, filed Sep. 30, 2009, which is hereby incorporated by reference herein in its entirety.

What is claimed is:

1. A recording medium comprising a substrate and two or more ink receiving layers provided on the substrate, wherein an upper layer of the ink receiving layers, which is a layer most distant from the substrate, and a lower layer, which is a layer located just under the upper layer, are ink receiving layers containing at least one selected from alumina hydrate and alumina, an acid and a hydrophilic binder, and wherein the acid contained in the upper layer is a carboxylic acid represented by the following general formula [I], and the acid contained in the lower layer is a sulfonic acid represented by the following general formula [II]:

$R^1$—COOH General formula [I]

where in the general formula [I], $R^1$ is a hydrogen atom or a branched or unbranched alkyl or alkenyl group having 1 to 3 carbon atoms, with the proviso that $R^1$ may have at least one of a hydroxyl group, an oxo group, an amino group (—NHR or —NRR'), an alkoxy group (—OR), an acyl group (R—CO—), alkanoylamino group (—NH-COR) and a carbamoyl group as a substituent, R and R' are, independently of each other, a hydrogen atom or an alkyl group having 1 or 2 carbon atoms, and R is not a hydrogen atom when the substituent is an alkoxy group or an alkanoylamino group, $R^2$—$SO_3H$ General formula [II]

where in the general formula [II], $R^2$ is a hydrogen atom or a branched or unbranched alkyl or alkenyl group having 1 to 3 carbon atoms, with the proviso that $R^2$ may have at least one of an oxo group, halogen atoms, an alkoxy group (—OR) and an acyl group (R—CO—) as a substituent, R is a hydrogen atom or an alkyl group having 1 or 2 carbon atoms, and R is not a hydrogen atom when the substituent is an alkoxy group, wherein the upper layer contains the carboxylic acid represented by the general formula [I] in an amount of 200 mmol or more and 500 mmol or less per 1 kg in total of the alumina hydrate and alumina.

2. The recording medium according to claim 1, wherein a solid content coating amount of the upper layer is 7 $g/m^2$ or more and 20 $g/m^2$ or less, and a solid content coating amount of the lower layer is 10 $g/m^2$ or more.

3. The recording medium according to claim 1, wherein the lower layer contains the sulfonic acid represented by the general formula [II] in an amount of 100 mmol or more and 300 mmol or less per 1 kg in total of the alumina hydrate and alumina.

* * * * *